US008573561B2

(12) United States Patent
Su

(10) Patent No.: US 8,573,561 B2
(45) **Date of Patent: *Nov. 5, 2013**

(54) MANUALLY OPERATED PRYING TOOL

(76) Inventor: Cheng-Wei Su, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/531,814

(22) Filed: Jun. 25, 2012

(65) Prior Publication Data

US 2012/0261628 A1 Oct. 18, 2012

Related U.S. Application Data

(63) Continuation-in-part of application No. 12/647,438, filed on Dec. 25, 2009, now Pat. No. 8,297,596.

(30) Foreign Application Priority Data

Jan. 12, 2009 (TW) ..... 98100961 A

(51) Int. Cl.
*B66F 3/00* (2006.01)

(52) U.S. Cl.
USPC ..... 254/129; 254/131.5

(58) Field of Classification Search
USPC ..... 254/129, 131.5, 120; 81/177.7, 177.8; 403/97
See application file for complete search history.

(56) References Cited

U.S. PATENT DOCUMENTS

| | | | | |
|---|---|---|---|---|
| 928,375 | A * | 7/1909 | Frick | 81/177.8 |
| 2,921,773 | A | 1/1960 | Hoelzer | 254/129 |
| 3,186,265 | A | 6/1965 | Wenturine et al. | 81/177.9 |
| 5,277,427 | A | 1/1994 | Bryan et al. | 473/232 |
| 5,473,929 | A | 12/1995 | Karash | 72/458 |
| 5,499,559 | A * | 3/1996 | Lin | 81/59.1 |
| 5,860,337 | A * | 1/1999 | Janssen | 81/63 |
| 6,216,565 | B1 * | 4/2001 | McCann | 81/177.8 |
| 6,840,141 | B2 * | 1/2005 | Cole | 81/177.8 |
| 6,920,807 | B2 | 7/2005 | Bond | 81/45 |
| 7,025,331 | B2 | 4/2006 | Whelan | 254/25 |
| 7,267,033 | B1 | 9/2007 | Lai | 81/57.29 |
| 7,278,626 | B1 | 10/2007 | Chang | 254/25 |
| 7,520,199 | B2 | 4/2009 | Stawarski | 81/177.8 |
| 7,628,382 | B2 | 12/2009 | Cole | 254/25 |
| 7,682,099 | B2 | 3/2010 | Cole | 403/97 |
| 2007/0113711 | A1 | 5/2007 | Tuan Mu | 81/63.2 |
| 2007/0158626 | A1 | 7/2007 | Chang | 254/25 |
| 2007/0169590 | A1 | 7/2007 | Cole | 81/177.8 |

OTHER PUBLICATIONS

Taiwanese Utility Model Publication No. TW M260372, Apr. 1, 2005, 11 pages.
Taiwanese Patent Publication No. TW 492908, Jul. 1, 2002, 4 pages.

(Continued)

*Primary Examiner* — Basil Katcheves
(74) *Attorney, Agent, or Firm* — Alan Kamrath; Kamrath IP Lawfirm, P.A.

(57) ABSTRACT

A manually operated prying tool comprises a prying head and a handle. The prying head is defined at its end with an assembling hole in which are disposed a head portion of a handle of the prying tool, a ratchet wheel, a C-shaped ring, a central shaft, a spring and a cover member. By pushing the central shaft, the prying tool can be switched between a fixing mode, an adjustment mode, or a rotation mode, which allows the user to unidirectionally rotate the tool to perform micro-angle adjustment between the prying head and the handle of the prying tool, making it convenient to use the tool.

9 Claims, 13 Drawing Sheets

(56) References Cited

OTHER PUBLICATIONS

Taiwanese Utility Model Publication No. TW 232230, Oct. 11, 1994, 3 pages.
Chinese Utility Model Publication No. CN 201169521Y, Dec. 24, 2008, 6 pages.
German Patent Publication No. DE 102006028115A1, Dec. 27, 2007, 7 pages.
Japanese Patent Publication No. JP 2003-300179A, Oct. 21, 2003, 6 pages.
Japanese Patent Publication No. JP 9-131670A, May 20, 1997, 3 pages.

* cited by examiner

MANUALLY OPERATED PRYING TOOL

The present application is a continuation-in-part application of U.S. patent application Ser. No. 12/647,438, filed on Dec. 25, 2009 now U.S. Pat. No. 8,297,596, of which the entire disclosure is incorporated herein.

BACKGROUND OF THE INVENTION

1. Field of the Invention

The present invention relates to a rotation control device for a manually operated plying tool.

2. Description of the Related Art

U.S. Pat. No. 7,278,626 discloses an adjustable prying tool comprises a prying head, a handle and a checking mechanism. The prying head is perpendicularly connected to the handle, and has an arcuate body having a flat tipped front end and a lug at a rear end, whereas the handle has at front end a hexagon hole enabling to insert into the lug of the prying head. The lug has a circular depression in an upper portion including an internal stopping ring on the opposite side of the depression having a plurality of inverse radial teeth. The checking mechanism has a hexagon plate embedded into the hexagon hole of the handle including a stop ring having a plurality of positive radial teeth engageable with the plurality of inverse radial teeth of the internal stop ring of the prying head, an upper cover covers the circular depression of the lug and then engages with the hexagon plate, a lower cover screws with the lower portion of the lug, a resilient member is engaged between the hexagon plate and the lower cover to provide resilient force therein.

In normal condition, the plurality of positive radial teeth of the stop ring of the hexagon plate is pushed by the resilient member to engage with the plurality of inverse radial teeth of the internal stopping ring of the prying head, so the prying head and the handle are fixed relative to each other, and the angle therebetween is fixed and not adjustable.

When the plurality of positive radial teeth of the stop ring of the hexagon plate is disengaged from the plurality of inverse radial teeth of the internal stopping ring of the prying head by pressing the upper cover, the prying head can be rotated bidirectionally, and thus the angle between the prying head and the handle is adjustable.

When the abovementioned conventional prying tool is in use, its handle can be fixed or rotated with respect to the prying head. However, in actual practice, there is such a requirement for micro angle adjustment (such as 5 degrees) between the prying head and the handle, with the conventional structure, the user has to press the upper cover and then carry out adjustment appropriately, hence, not only is it impossible for the user to handle the prying tool with one hand, but the user to perform such micro angle adjustment is required to be experienced and skilled.

The present invention is, therefore, intended to obviate or at least alleviate the problems encountered in the prior art.

SUMMARY OF THE INVENTION

The primary object of the present invention is to provide a manually operated prying tool which comprises a prying head and a handle. The head is defined at its end with an assembling hole in which are disposed a head portion of a handle of the prying tool, a ratchet wheel, a C-shaped ring, a central shaft, a spring and a cover member. By pushing the central shaft, the prying tool can be switched into a fixing mode, adjustment mode, or a rotation operation mode, which allows the user to unidirectionally rotate the tool to perform micro-angle adjustment between the prying head and the handle of the prying tool, making it convenient to use the tool. Hence, a manually operated prying tool is provided in accordance with the above object of the present invention and comprises a prying head and a handle. The head is defined at its end with an assembling hole in which are disposed a head portion of a handle of the prying tool, a ratchet wheel, a C-shaped ring, a central shaft, a spring and a cover member. The prying head is provided with a prying end at one end thereof and an assembling hole at another other end thereof, a first assembling portion and a second assembling portion are formed at both ends of the assembling hole, in the first assembling portion is defined an assembling aperture, the second assembling portion is defined with a two-step toothed groove and a through hole, the two-step toothed groove is defined with a plurality of annularly arranged bevel blocks, on a top of each of the bevel blocks is formed a bevel surface, and at a lower end of each of the bevel blocks is formed a protruding tooth, in an inner surface of the through hole is defined an annular engaging edge. The handle includes a gripping portion at one end and a head portion at the other, the head portion is formed with a ratchet hole, the head portion is disposed in the assembling hole of the prying head, and the ratchet hole is aligned and in communication with the assembling hole and the through hole. The ratchet wheel is provided with outer teeth, a central hole, and a stop flange at a lower end of an inner surface of the central hole, the ratchet wheel is inserted through the assembling aperture into the assembling hole of the prying head, and the outer teeth of the ratchet wheel are engaged with the ratchet hole of the handle and the two-step toothed groove of the prying head. The central shaft is formed with an outer annular shoulder portion, an annular protruding flange and an annular groove, the central shaft is inserted into the prying head via the assembling aperture and simultaneously into the assembling hole, the central hole of the ratchet wheel, the two-step toothed groove and the through hole. The C-shaped ring is a flexible annular structure engaged in the annular groove of the central shaft and partially protruded out of the annular groove when engaged therein. The spring is inserted through the assembling aperture onto the central shaft and has one end contacting the stop flange of the ratchet wheel. The cover member is formed with an engaging hole and disposed in the assembling aperture, the cover member is inserted on the central shaft via its engaging hole in such a manner that an inner end surface of the cover member is in contact with one end of the spring, the shoulder portion of the central shaft and one end of the ratchet wheel, so as to prevent the spring, the central shaft and the ratchet wheel from disengaging from the prying head.

Other objects, advantages, and new features of the present invention will become apparent from the following detailed description of the invention when considered in conjunction with the accompanied drawings.

BRIEF DESCRIPTION OF THE DRAWINGS

The illustrative embodiment may best be described by reference to the accompanying drawings where.

DETAILED DESCRIPTION OF THE PREFERRED EMBODIMENTS

Figure 1:
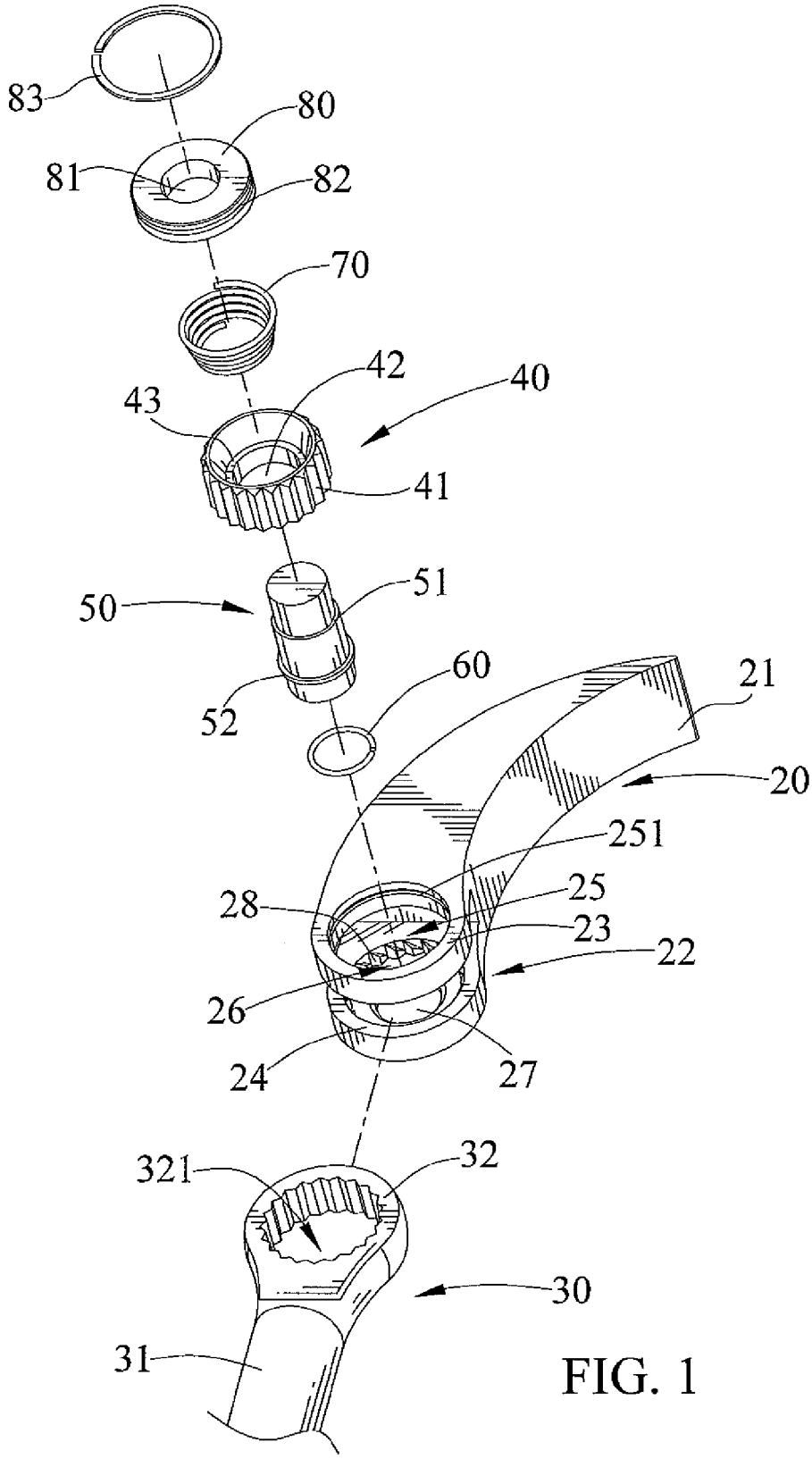
FIG. 1 is an exploded view of a prying tool in accordance with the present invention.
Figure 2:
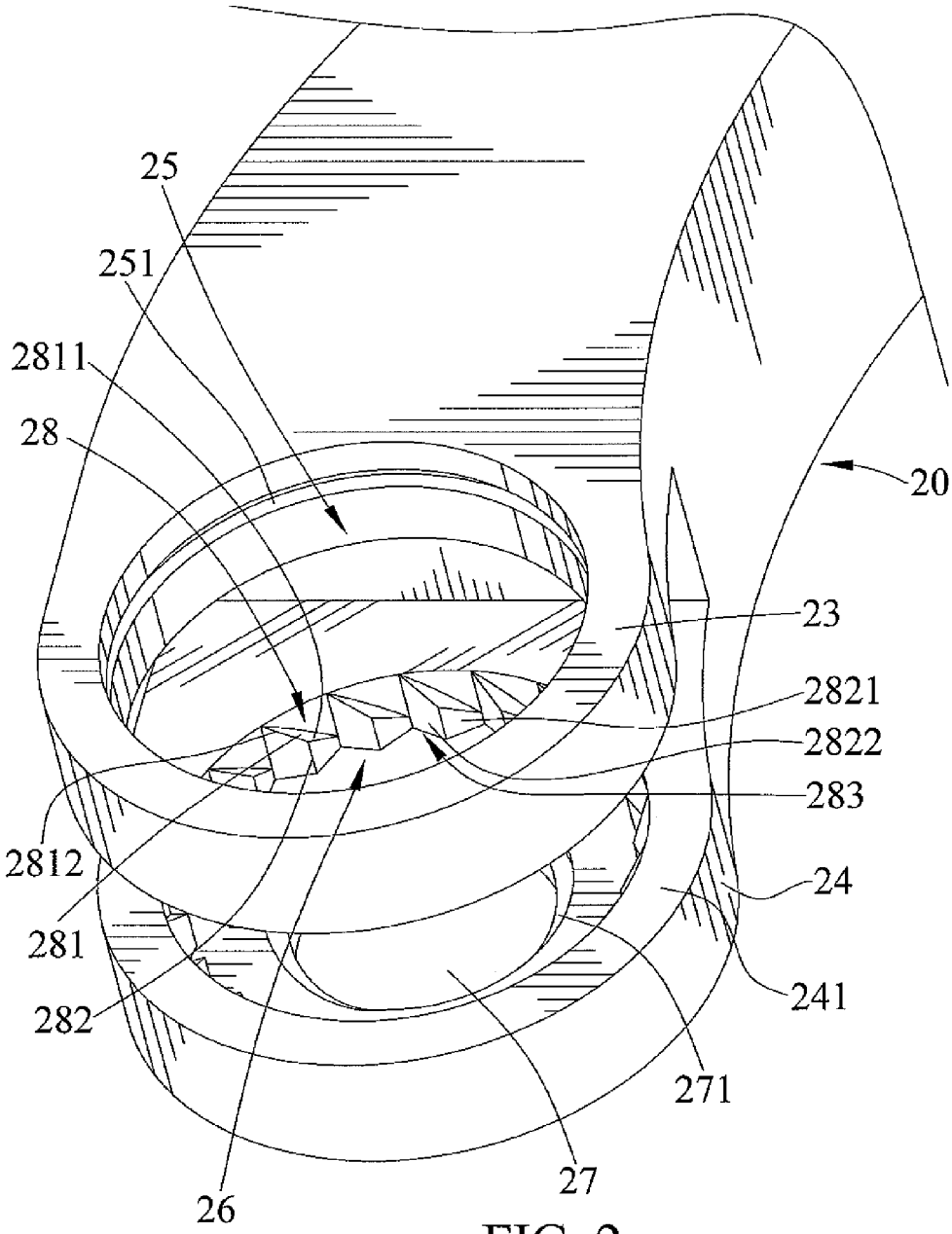
FIG. 2 is an amplified view of the prying tool of FIG. 1.
Figure 3:
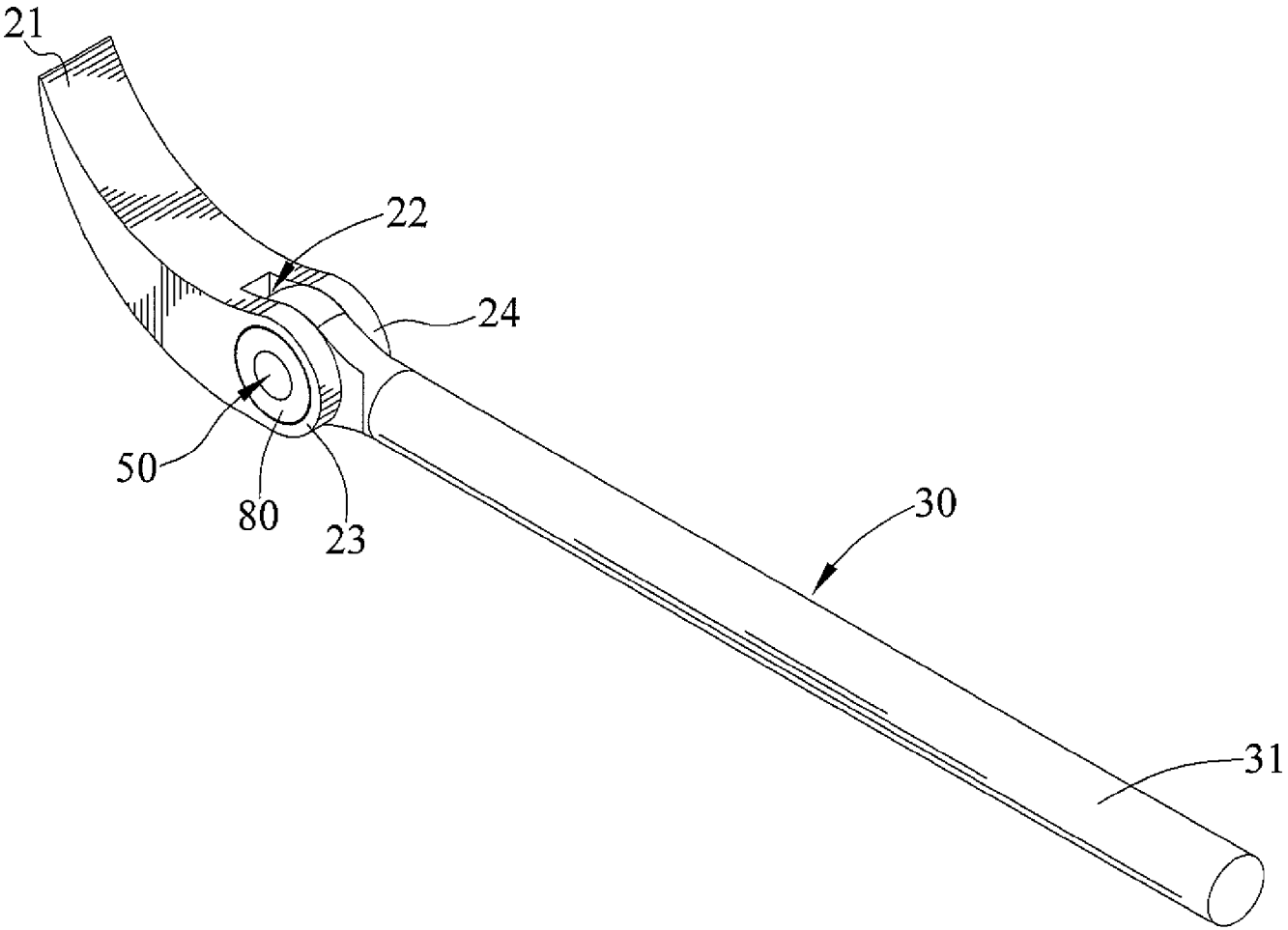
FIG. 3 is an assembly view of the prying tool in accordance with the present invention.

The present invention will be clearer from the following description when viewed together with the accompanying drawings, which show, for purpose of illustrations only, the preferred embodiment in accordance with the present invention.

Referring to FIGS. 1 through 13, a manually operated prying tool in accordance with the present invention comprises a prying head 20 and a handle 30. The prying head 20 is defined at its end with an assembling hole 22 in which are disposed a head portion 32 of a handle 30 of the prying tool, a ratchet wheel 40, a C-shaped ring 60, a central shaft 50, a spring 70 and a cover member 80.

The prying head 20 is provided with a prying end 21 at one end thereof, and the assembling hole 22 is formed at the other end of the prying head 20. Formed at both ends of the assembling hole 22 are a first assembling portion 23 and a second assembling portion 24, in the first assembling portion 23 is defined an assembling aperture 25, and in an inner wall of the assembling aperture 25 is formed an annular engaging groove 251. The second assembling portion 24 is defined with a two-step toothed groove 26 and a through hole 27. The two-step toothed groove 26 is defined with a plurality of annularly arranged bevel blocks 28, on the top of each of the bevel blocks 28 is formed a bevel surface 281, and at the lower end of each of the bevel blocks 28 is formed a protruding tooth 282 inwardly protruding toward a radial direction of the two-step toothed groove 26. Each of the bevel surfaces 281 includes first and second sections 2811 and 2812 connecting to each other. The first section 2811 is arranged at the lower end of the bevel surface 281, and correspondingly the second section 2812 is arranged at the higher end of the bevel surface 281. The first and second sections 2811 and 2812 have different horizontal positions from the bottom of the two-step toothed groove 26. Moreover, the horizontal position of the first section 2811 is higher than the horizontal position of the second section 2812, and the first and second sections 2811 and 2812 have the same slope. The first section 2811 is connected with an inner surface 241 of the second assembling portion 24. Each of the protruding tooth 282 is defined first and second engaging surfaces 2821 and 2822 connecting to each other and formed an included angle. Each first engaging surface 2821 of the protruding tooth 282 and each second engaging surface 2822 of the adjacent protruding tooth 282 conjointly delimit an engaging recess 283. In the inner surface of the through hole 27 is defined an annular engaging edge 271.

The handle 30 includes a gripping portion 31 at one end thereof and a head portion 32 at the other end thereof. The head portion 32 is formed with a ratchet hole 321 provided with inner ratchets arranged corresponding to the plurality of engaging recesses 283. The head portion 32 is disposed in the assembling hole 22 of the prying head 20, and the ratchet hole 321 is aligned and in communication with the assembling aperture 25 and the through hole 27.

The ratchet wheel 40 is provided with outer teeth 41, a central hole 42, and a stop flange 43 at a lower end of the inner surface of the central hole 42. The ratchet wheel 40 is inserted through the assembling aperture 25 into the assembling hole 22 of the prying head 20, and the outer teeth 41 of the ratchet wheel 40 are engaged with the ratchet hole 321 of the handle 30 and the two-step toothed groove 26 of the prying head 20.

The central shaft 50 is formed with an outer annular shoulder portion 51, an annular protruding flange 52 and an annular groove 53. An inner diameter of the annular groove 53 is less than an inner diameter of the annular engaging edge 271 of the through hole 27. The central shaft 50 is inserted into the prying head 20 via the assembling aperture 25 and simultaneously into the assembling hole 22, the central hole 42 of the ratchet wheel 40, the two-step toothed groove 26 and the through hole 27.

The C-shaped ring 60 is a flexible annular structure selectively engaged in the annular groove 53 of the central shaft 50 or the annular engaging edge 271 and partially protrudes out of the annular groove 53 when it is engaged therein.

The spring 70 inserted through the assembling aperture 25 onto the central shaft 50 and has one end contacting the stop flange 43 of the ratchet wheel 40, and the other end abutting against the cover member 80.

The cover member 80 is formed with an engaging hole 81, and around the outer periphery of the cover member 80 is formed an annular retaining groove 82. The cover member 80 is disposed in the assembling aperture 25 and retained therein by a C-shaped retainer 83 disposed in the retaining groove 82 and the engaging groove 251. The cover member 80 is inserted on the central shaft 50 via the engaging hole 81 in such a manner that an inner end surface of the cover member 80 is in contact with the other end of the spring 70, the shoulder portion 51 of the central shaft 50 and the end of the ratchet wheel 40, so as to prevent the spring 70, the central shaft 50 and the ratchet wheel 40 from disengaging from the prying head 20.

For a better understanding of the embodiment of the present invention, its operation and effect, reference should be made to FIGS. 3-6 again, in assembly of the prying tool, the head portion 32 of the handle 30 is inserted in the assembling hole 22 of the prying head 20, making the ratchet hole 321 aligned and in communication with the assembling aperture 25 and the through hole 27. Then the ratchet wheel 40 is inserted in the assembling hole 22 through the assembling aperture 25 of the prying head 20 in such a manner that the outer teeth 41 of the ratchet wheel 40 are engaged with the ratchet hole 321 of the handle 30 and the two-step toothed groove 26 of the prying head 20. After that, the central shaft 50 is inserted through the assembling aperture 25 into the prying head 20 and simultaneously into the assembling aperture 25, the central hole 42 of the ratchet wheel 40, the two-step toothed groove 26 and the through hole 27, and then the C-shaped ring 60 and the spring 70 are inserted onto the central shaft 50, and finally the assembly of the prying tool can be finished by sealing the assembling aperture 25 with the cover member 80.

The prying tool of the present invention provides three operation modes, namely, the prying head 20 and the handle 30 of the prying tool can be fixed (fixing mode) or can rotate (rotation mode) with respect to each other, and the angle between the prying head and the handle of the prying tool can be adjusted (adjustment mode).

Figure 4:
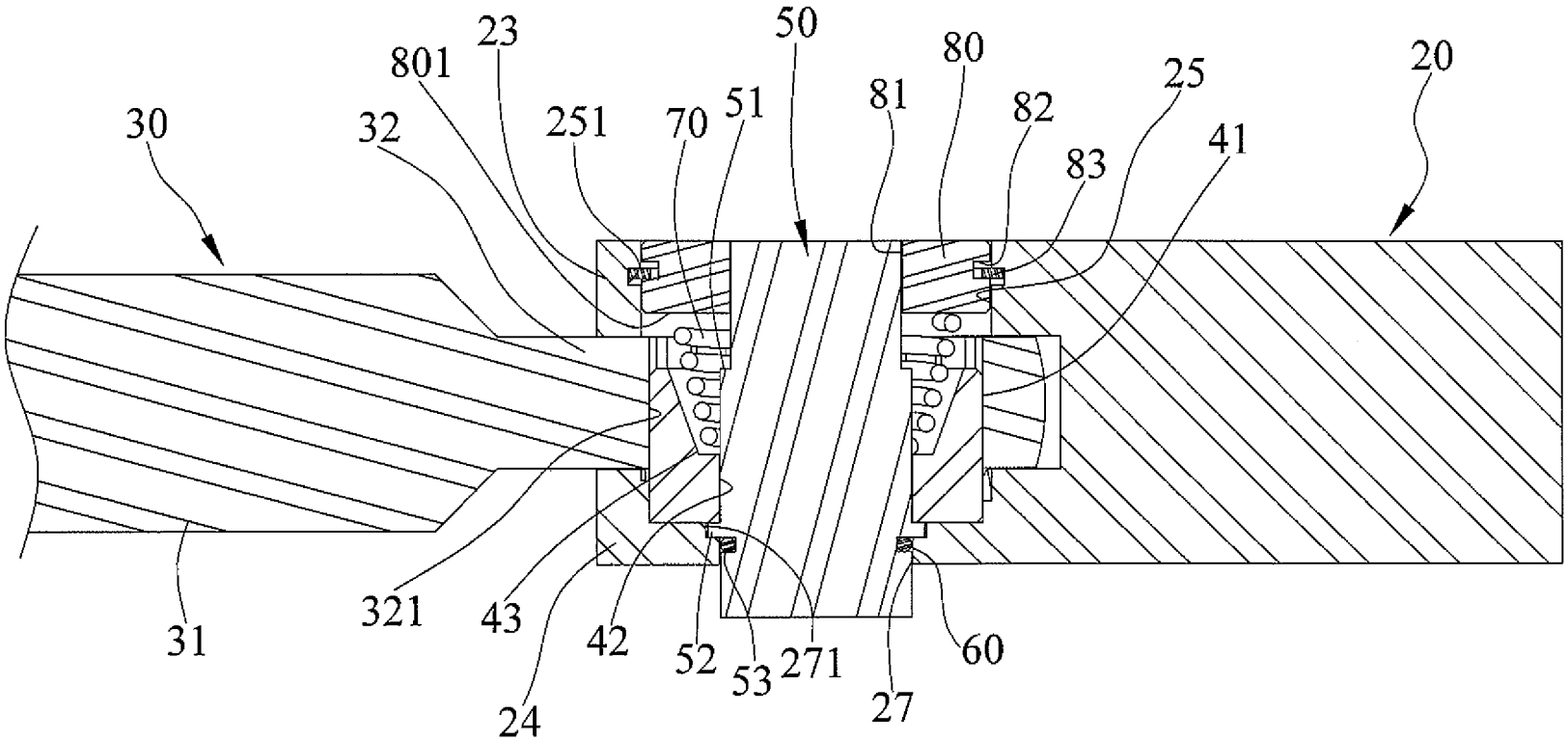
FIG. 4 is a cross sectional view showing that the prying tool in accordance with the present invention is set in a fixing mode.
Figure 5:
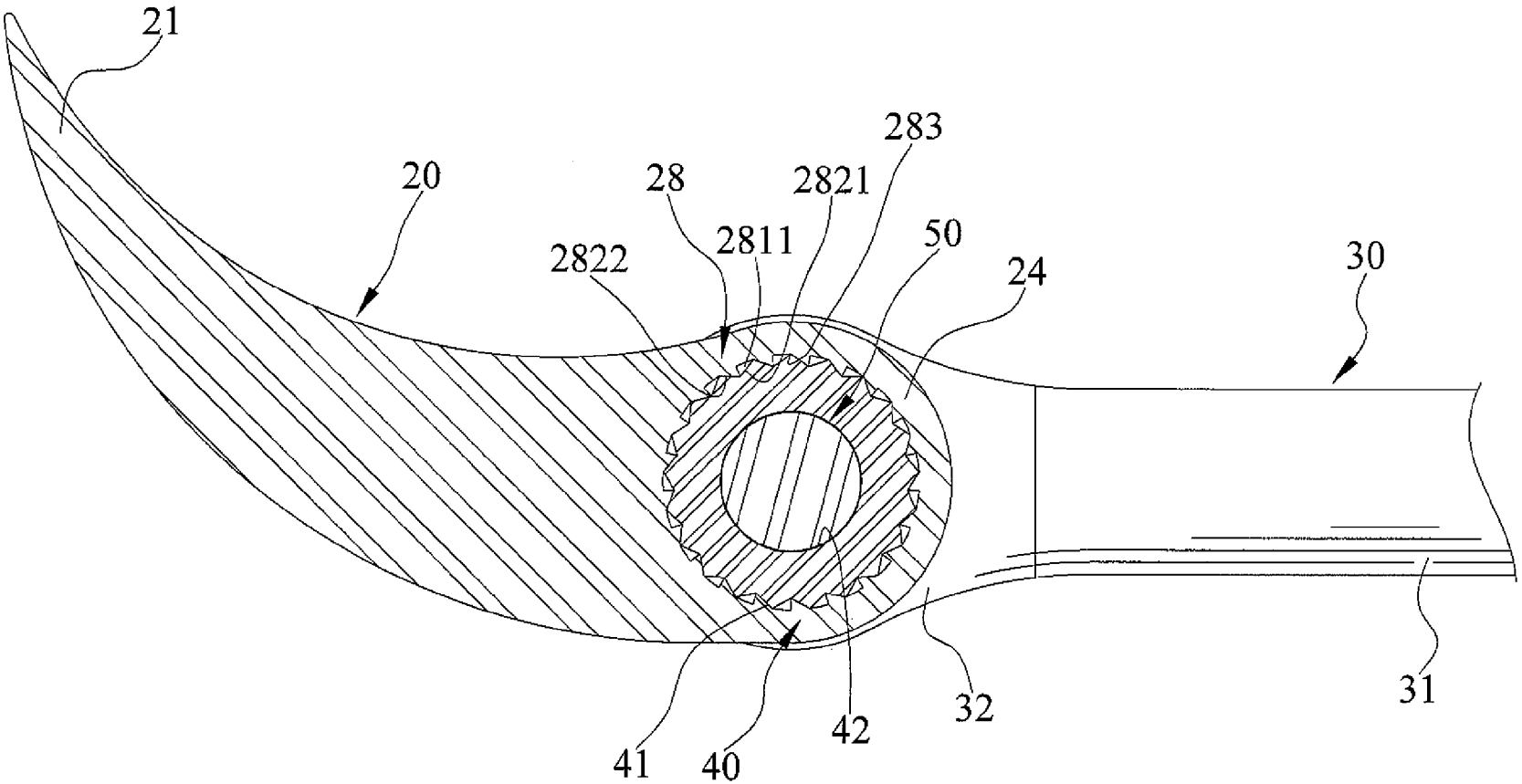
FIG. 5 is another cross sectional view showing that the prying tool in accordance with the present invention is set in a fixing mode.
Figure 6:
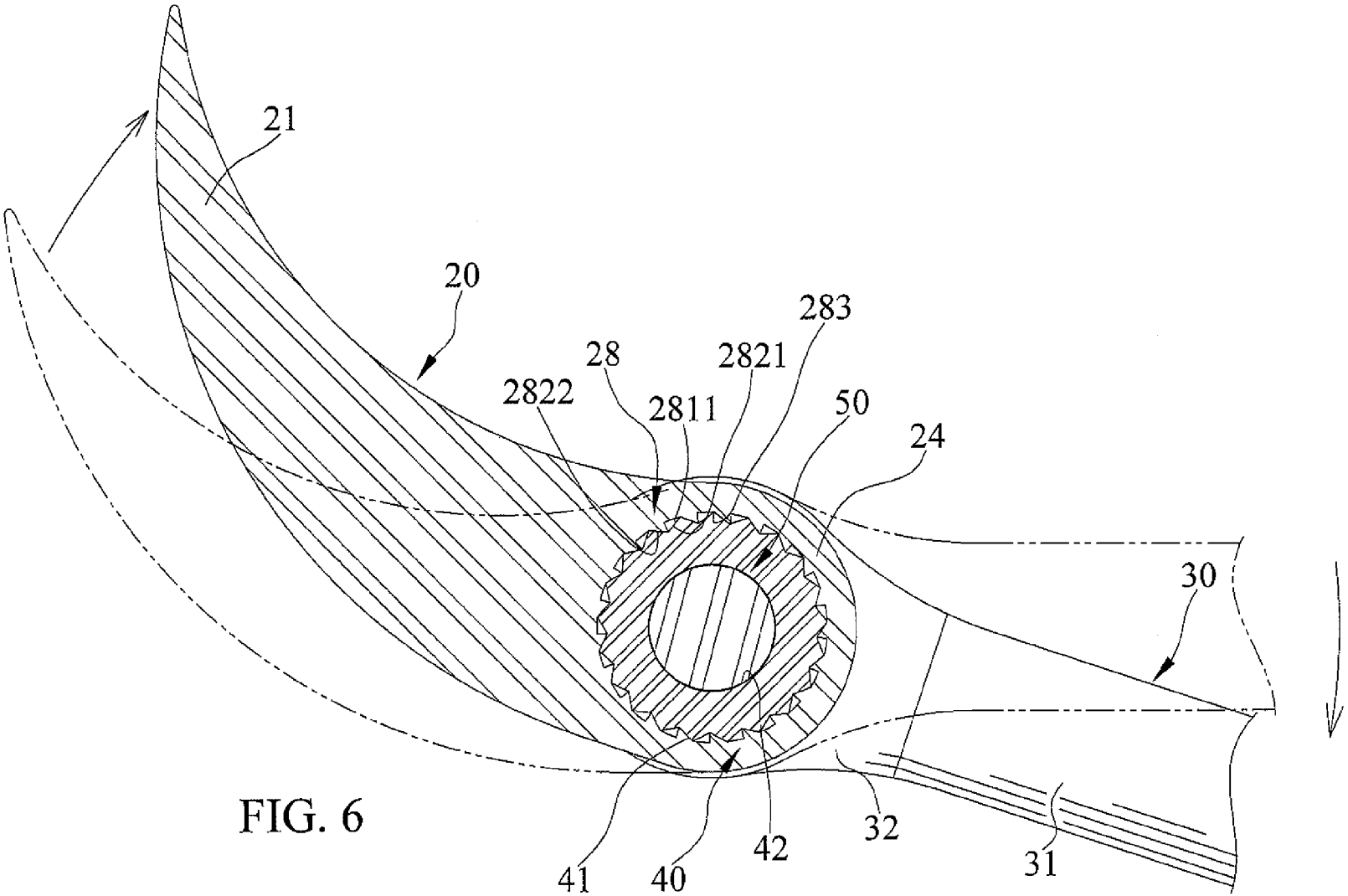
FIG. 6 is a continued cross-section view of FIG. 5 showing that the prying tool is set in a fixing mode and rotated in a driving rotation direction.
Figure 7:
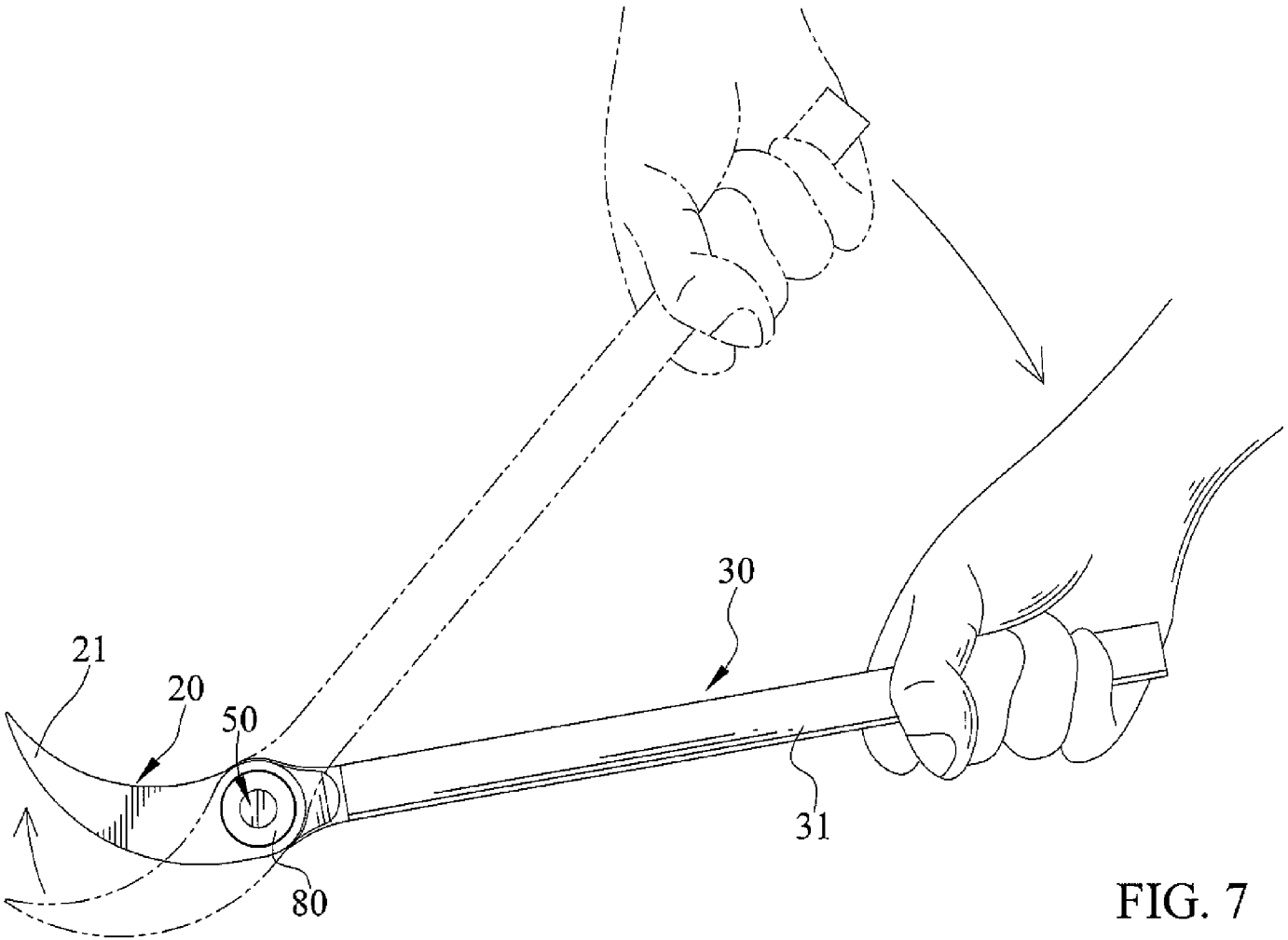
FIG. 7 is a perspective view showing that the prying tool in accordance with the present invention is set in the fixing mode and rotated in a driving rotation direction.
Figure 8:
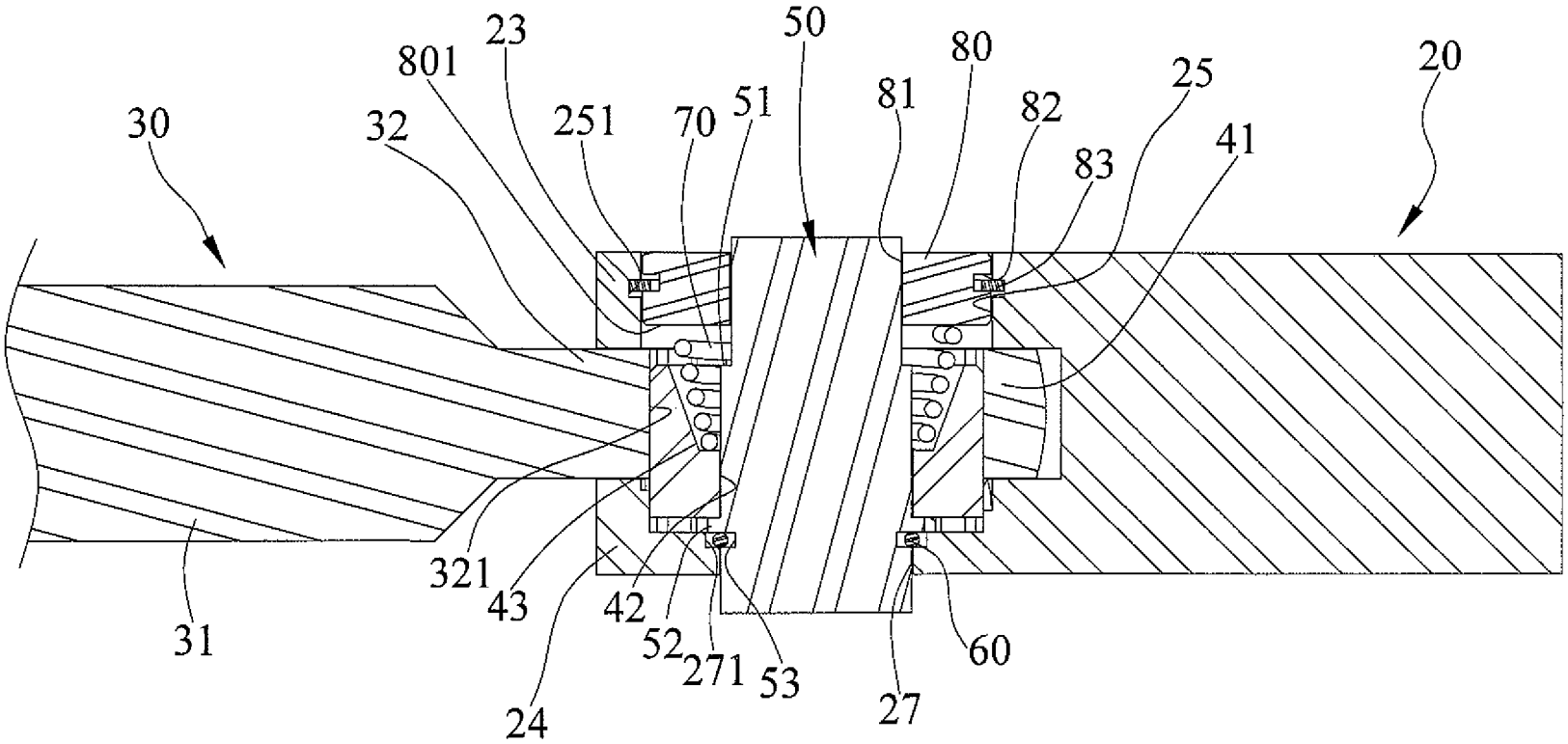
FIG. 8 is a cross sectional view showing that the prying tool in accordance with the present invention is set in an adjustment mode.
Figure 9:
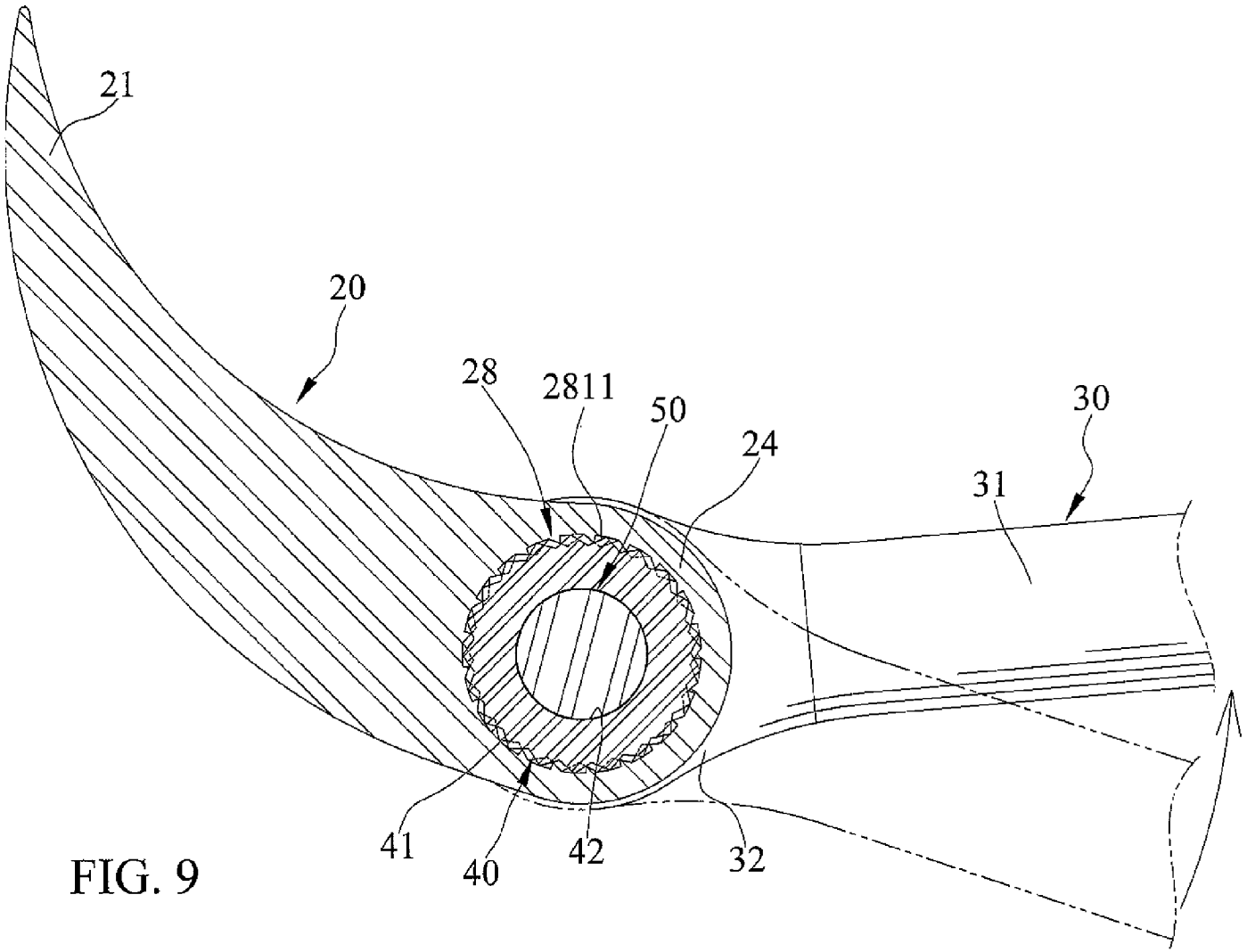
FIG. 9 is another cross sectional view showing that the prying tool in accordance with the present invention is set in the adjustment mode and rotated in a non-driving rotation direction.
Figure 10:
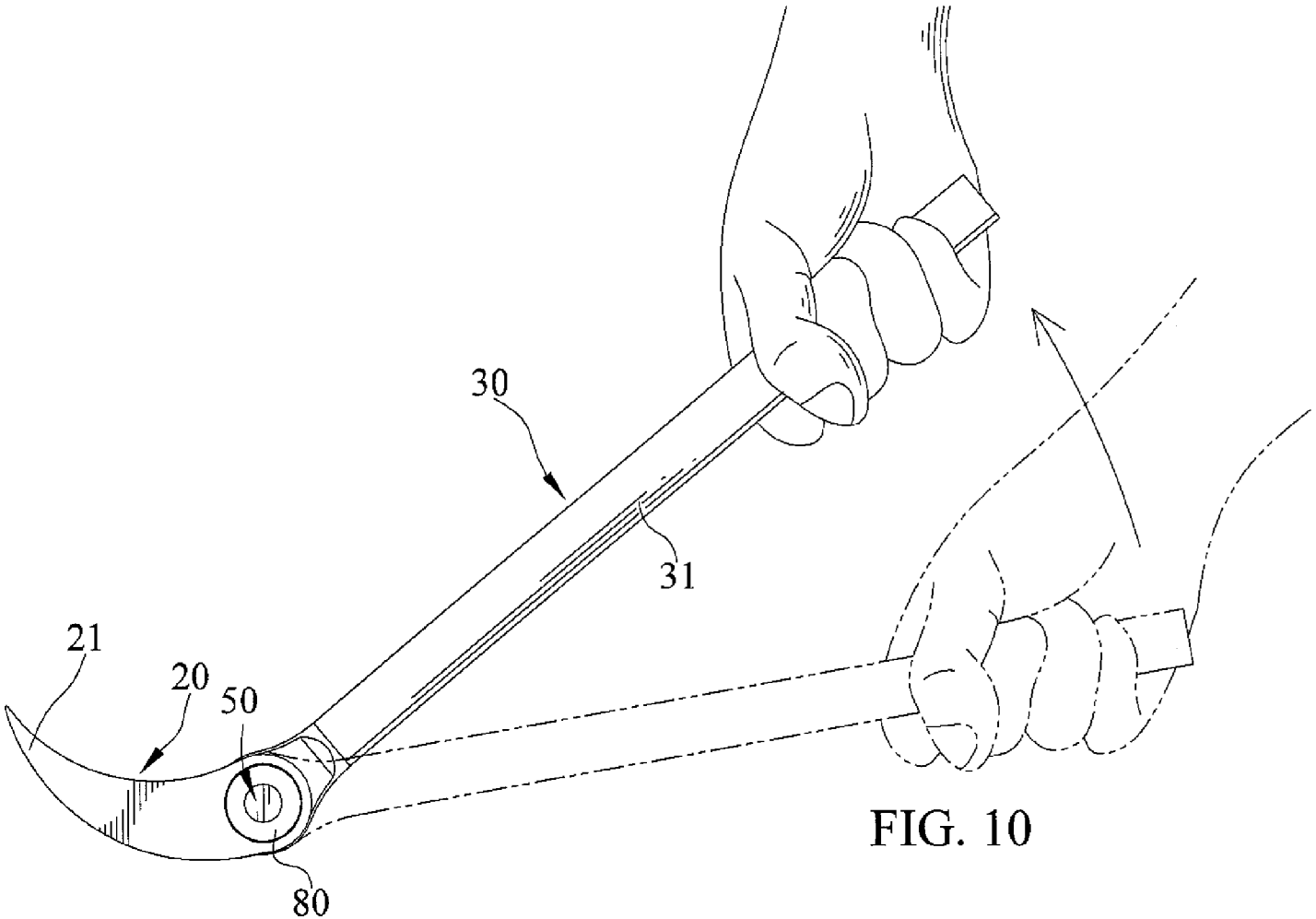
FIG. 10 is a perspective view showing that the prying tool in accordance with the present invention is set in the adjustment mode and rotated in the non-driving rotation direction.
Figure 11:
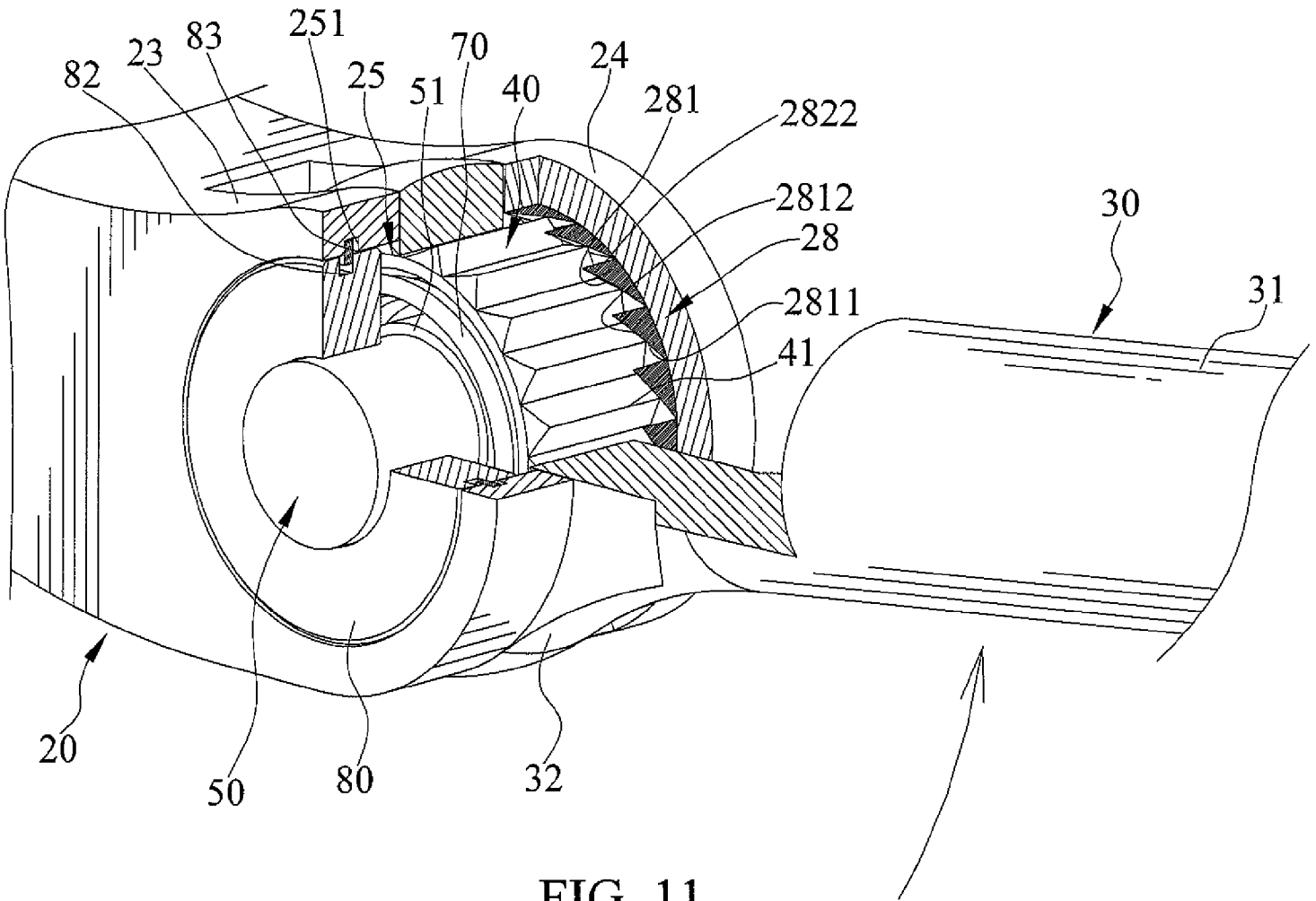
FIG. 11 is an enlarged partial cross sectional view showing that the prying tool in accordance with the present invention is set in the adjustment mode and rotated in the non-driving rotation direction and a ratchet wheel engaged with a first section of a bevel surface of bevel blocks.
Figure 12:
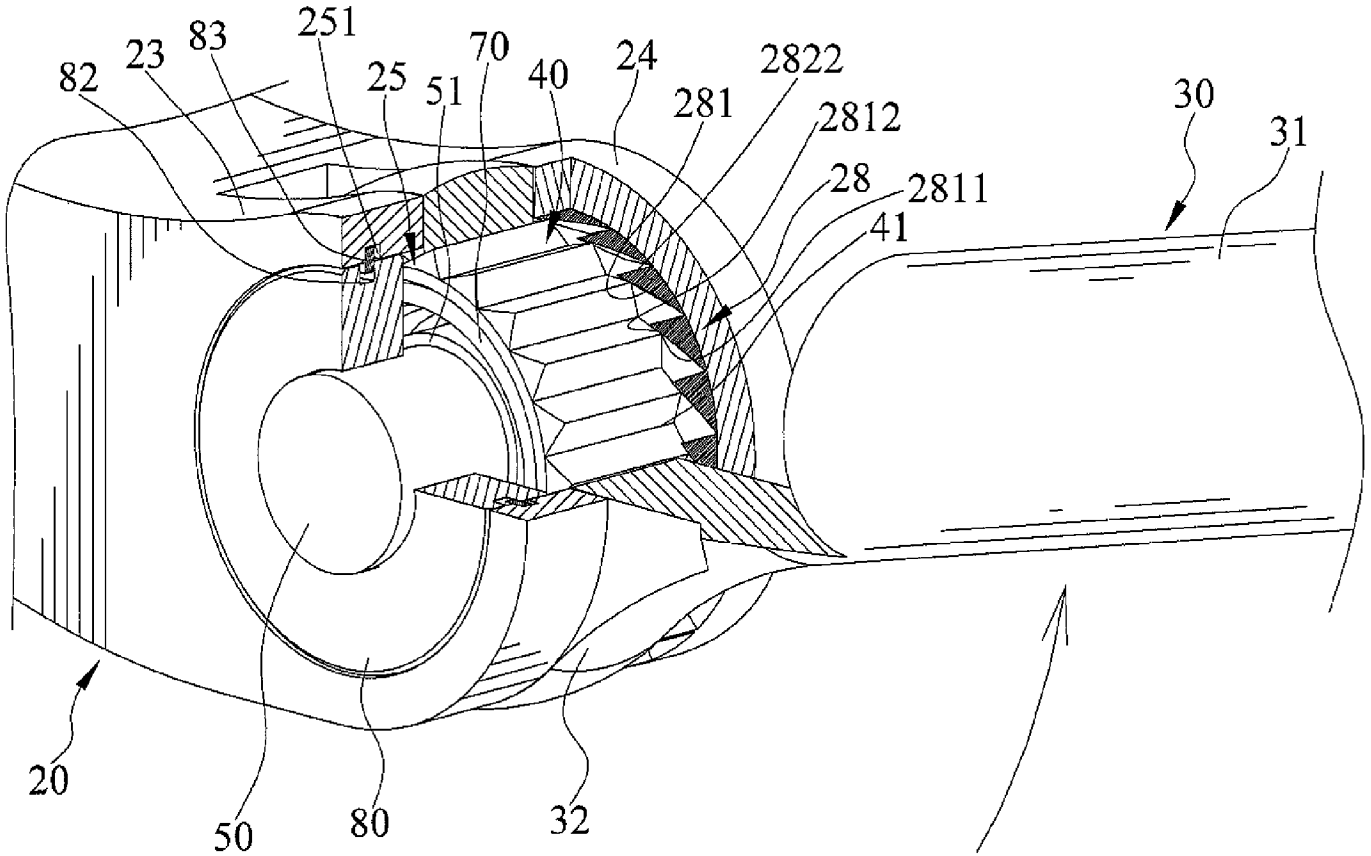
FIG. 12 is a continued enlarged partial cross-section view of FIG. 11 showing that the prying tool in accordance with the present invention is set in the adjustment mode and rotated in the non-driving rotation direction and a ratchet wheel engaged with a second section of a bevel surface of bevel blocks.

Referring to FIGS. 4 through 7, to switch the prying tool to the fixing mode, namely, to make the prying head 20 and the hand 30 of the prying tool fixed with respect to each other, the user can push the central shaft 50 toward the through hole 27 until the annular protruding flange 52 of the central shaft 50 is engaged in the annular engaging edge 271, then the prying head 20 and the hand 30 of the prying tool are fixed with respect to each other, as shown in FIG. 4. When the central shaft 50 is being pushed, the spring 70 will push the ratchet wheel 40 to make the outer teeth 41 of the ratchet wheel 40 engage with the protruding teeth 282 and is received into the engaging recesses 283 so that outer surfaces of the outer teeth 41 are respectively abutted against the first and second surfaces 2821 and 2822 of the protruding teeth 282. Meanwhile, the C-shaped ring 60 will be pushed backed into the annular groove 53 and in contact with the outer surface of the through hole 27. In the fixing mode, the ratchet wheel 40 and the prying head 20 are engaged together and not allowed to rotate relative to each other, and the handle 30 is also engaged with the prying head 20, at this mode, the user can hold the gripping portion 31 of the handle 30, and the prying tool can be rotated in a driving rotation direction (shown by the arrow in FIGS. 6 and 7) to perform prying tasks.

Referring then to FIGS. 8 through 12, to switch the prying tool to the adjustment mode, namely, to adjust the angle between the prying head 20 and the handle 30, the user can push the central shaft 50 toward the assembling aperture 25 until the C-shaped ring 60 is engaged in the annular engaging edge 271, and the ratchet wheel 40 is pushed by the annular protruding flange 52 of the central shaft 50, at this moment, the outer teeth 41 of the ratchet wheel 40 are engaged with the first sections 2811 of the bevel surfaces 281 of the bevel blocks 28, which means that the ratchet wheel 40 and the prying head 20 are in partial engagement with each other, so that the user can rotate the prying head 20 unidirectionally. Particllarly, the user can rotate the prying head 20 in a non-driving rotation direction (shown by the arrow in FIGS. 9 and 10) reverse to the driving rotation direction. During rotation, (for easy description, only one outer tooth 41 is described) the tooth 41 of the ratchet wheel 40 moves upward toward the assembling aperture 25 from the first sections 2811 of the bevel surface 281 of one bevel block 28, when it moves to the second sections 2812 of the bevel surface 281 of the bevel block 28, the travel for one-tooth-angle adjustment has been finished and the outer tooth 41 will move back down to the first sections 2811 of the bevel surface 281 of the next bevel block 28 to cause the outer tooth 41 resisted by the second engaging surface 2822 of the protruding tooth 282 of the previous bevel block 28, so that the prying tool still can be rotated in the driving rotation direction to perform prying tasks, and thus one-tooth-angle adjusted is completed, and by repeating the above operation, the angle between the prying head 20 and the handle 30 is adjusted.

It is to be noted that, in normal conditions, the prying tool can preferably be set in the adjustment mode, so that the user can easily unidirectionally rotate the prying head 20 so as to perform micro-angle or large-angle adjustment between the prying head 20 and the handle 30. Unlike the conventional structure, the angle adjustment of the present invention doesn't require the user to press the button with the other hand, furthermore, the adjustment mode of the present invention allows the angle of the prying head 20 to be adjusted in an angel by angle manner, and hence, it is a more precise angle adjustment than the conventional structure.

Figure 13:
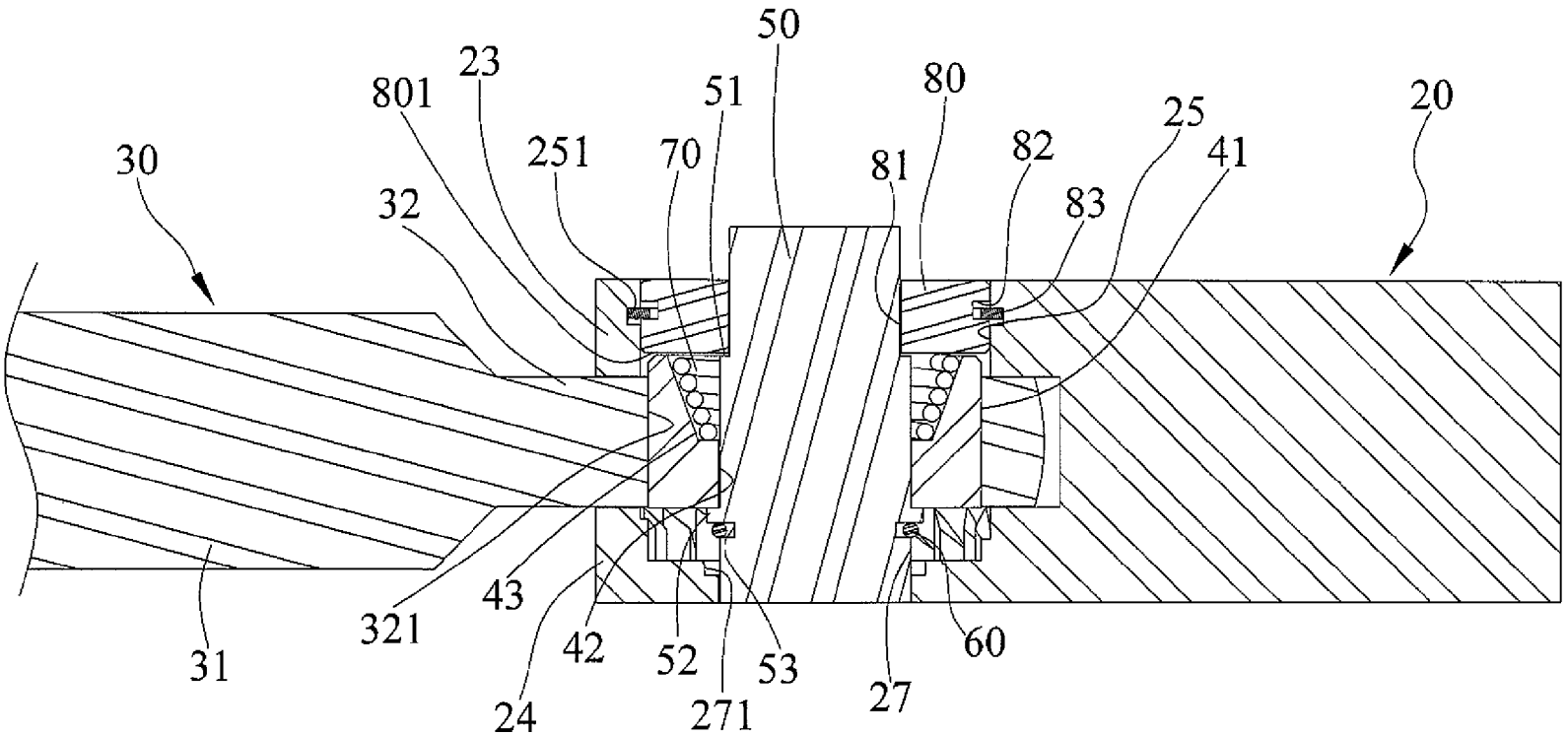
FIG. 13 is a cross sectional view showing that the prying tool in accordance with the present invention is set in a rotation mode.

Referring finally to FIG. 13, to switch the prying tool into the rotation mode, the user can push the central shaft 50 toward the assembling aperture 25 until the shoulder portion 51 of the central shaft 50 abuts against the cover member 80, and thus the prying tool is switched into the rotation mode. At this moment, the outer teeth 41 of the ratchet wheel 40 will move out of contact with the bevel blocks 28. In this rotation mode, the ratchet wheel 40 and the prying head 20 are disengaged from each other, so that the user can rotate the prying head 20 bidirectionally, in other words, it allows a bidirectional angle adjustment between the prying head 20 and the handle 30.

Thus since the invention disclosed herein may be embodied in other specific forms without departing from the spirit or general characteristics thereof, some of which forms have been indicated, the embodiment described herein is to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A manually operated prying tool comprising:

a prying head provided with a prying end at one end thereof and an assembling hole at another other end thereof, a first assembling portion and a second assembling portion being formed at both ends of the assembling hole, in the first assembling portion being defined an assembling aperture, the second assembling portion being defined with a two-step toothed groove and a through hole, the two-step toothed groove being defined with a plurality of annularly arranged bevel blocks, on a top of each of the bevel blocks being formed a bevel surface including first and second sections connecting to each other and the first and second sections have different horizontal positions from the bottom of the two-step toothed groove, and at a lower end of each of the bevel blocks being formed a protruding tooth defined first and second engaging surfaces connecting to each other and each first engaging surface of the protruding tooth and each second engaging surface of the adjacent protruding tooth conjointly delimit an engaging recess, in an inner surface of the through hole being defined an annular engaging edge;

a handle including a gripping portion at one end and a head portion at the other, the head portion being formed with a ratchet hole, the head portion being disposed in the assembling hole of the prying head, and the ratchet hole being aligned and in communication with the assembling hole and the through hole;

a ratchet wheel provided with outer teeth, a central hole, and a stop flange at a lower end of an inner surface of the central hole, the ratchet wheel being inserted through the assembling aperture into the assembling hole of the prying head, and the outer teeth of the ratchet wheel being engaged with the ratchet hole of the handle and the two-step toothed groove of the prying head;

a central shaft formed with an outer annular shoulder portion, an annular protruding flange and an annular groove, the central shaft being inserted into the prying head via the assembling aperture and simultaneously into the assembling hole, the central hole of the ratchet wheel, the two-step toothed groove and the through hole;

a C-shaped ring being a flexible annular structure engaged in the annular groove of the central shaft and partially protruded out of the annular groove when engaged therein;

a spring inserted through the assembling aperture onto the central shaft and having one end contacting the stop flange of the ratchet wheel; and a cover member being formed with an engaging hole and disposed in the assembling aperture, the cover member being inserted on the central shaft via its engaging hole in such a manner that an inner end surface of the cover member is in contact with one end of the spring, the shoulder portion of the central shaft and one end of the ratchet wheel, so as to prevent the spring, the central shaft and the ratchet wheel from disengaging from the prying head;

wherein the prying tool adapted to switch between a fixing mode, an adjustment mode, and a rotate mode;

wherein the prying tool is switched to the fixing mode, the outer teeth of the ratchet wheel are engaged with the protruding teeth and received into the engaging recesses so that outer surfaces of the outer teeth are respectively abutted against the first and second engaging surfaces of the protruding teeth, with the ratchet wheel and the prying head engaged together and not allowed to rotate relative to each other;

wherein the prying tool is switched to the adjustment mode, the outer teeth of the ratchet wheel are selectively engaged with the first and second sections of the bevel surfaces of the bevel blocks;

wherein the prying tool is switched to the rotate mode, the outer teeth of the ratchet wheel move out of contact with the bevel blocks.

2. The manually operated prying head as claimed in claim 1, wherein an annular engaging groove is formed in an inner wall of the assembling aperture of the prying head, around an outer periphery of the cover member is formed an annular retaining groove, the cover member is disposed in the assembling aperture and retained therein by a C-shaped retainer disposed in the retaining groove of the cover member and the engaging groove of the prying head.

3. The manually operated prying head as claimed in claim 1, wherein the first section is arranged at the lower end of the bevel surface and correspondingly the second section is arranged at the higher end of the bevel surface.

4. The manually operated prying head as claimed in claim 1, wherein the horizontal position of the first section is higher than the horizontal position of the second section.

5. The manually operated prying head as claimed in claim 1, wherein the first and second sections have the same slope.

6. The manually operated prying head as claimed in claim 1, wherein the ratchet hole provided with inner ratchets arranged corresponding to the plurality of engaging recesses.

7. The manually operated prying head as claimed in claim 1, wherein an inner diameter of the annular groove is less than an inner diameter of the annular engaging edge of the through hole.

8. The manually operated prying head as claimed in claim 1, wherein the first and second engaging surfaces connecting to each other and formed an included angle.

9. The manually operated prying head as claimed in claim 1, wherein the spring has one end contacting the stop flange of the ratchet wheel and the other end abutting against the cover member.

* * * * *